US010012082B2

(12) United States Patent
Muldoon

(10) Patent No.: US 10,012,082 B2
(45) Date of Patent: Jul. 3, 2018

(54) GAS TURBINE ENGINE SHAFT MEMBERS AND MAINTENANCE METHOD

(71) Applicant: United Technologies Corporation, Hartford, CT (US)

(72) Inventor: Marc J. Muldoon, Marlborough, CT (US)

(73) Assignee: United Technologies Corporation, Farmington, CT (US)

( * ) Notice: Subject to any disclaimer, the term of this patent is extended or adjusted under 35 U.S.C. 154(b) by 323 days.

(21) Appl. No.: 14/937,153

(22) Filed: Nov. 10, 2015

(65) Prior Publication Data

US 2016/0146103 A1 May 26, 2016

Related U.S. Application Data

(60) Provisional application No. 62/084,098, filed on Nov. 25, 2014.

(51) Int. Cl.

| | |
|---|---|
| ***F01D 5/06*** | (2006.01) |
| ***F01D 5/02*** | (2006.01) |
| *F01D 25/28* | (2006.01) |

(52) U.S. Cl.

CPC ..... *F01D 5/026* (2013.01); *F01D 25/285* (2013.01); *F05D 2220/323* (2013.01); *F05D 2230/70* (2013.01); *F05D 2250/281* (2013.01); *F05D 2260/37* (2013.01)

(58) Field of Classification Search

CPC .. F01D 5/026; F05D 2240/60; F05D 2230/70; F05D 2260/37

See application file for complete search history.

(56) References Cited

U.S. PATENT DOCUMENTS

| | | | | |
|---|---|---|---|---|
| 2,832,565 | A * | 4/1958 | Thomas | F01D 5/06 416/198 A |
| 2,980,474 | A * | 4/1961 | Gargan | B21B 31/07 137/625.11 |
| 4,737,076 | A * | 4/1988 | Bonner | F01D 5/025 403/273 |
| 4,804,288 | A * | 2/1989 | Tiernan, Jr. | F01D 5/026 403/24 |
| 4,936,003 | A | 6/1990 | Gloe | |
| 5,473,883 | A | 12/1995 | Naudet | |
| 6,886,227 | B1 | 5/2005 | Hedrick | |
| 8,402,741 | B1 | 3/2013 | Merry et al. | |
| 2013/0259599 | A1 | 10/2013 | Benjamin et al. | |
| 2013/0319000 | A1 | 12/2013 | Otto | |

FOREIGN PATENT DOCUMENTS

| | | |
|---|---|---|
| WO | 2015181017 | 12/2015 |

OTHER PUBLICATIONS

The Extended European Search Report for European Application No. 15196232.1, dated May 12, 2016.

* cited by examiner

*Primary Examiner* — Ninh H Nguyen

(74) *Attorney, Agent, or Firm* — Carlson, Gaskey & Olds, P.C.

(57) ABSTRACT

A gas turbine engine includes first and second shaft members in an interference fit relationship with one another at an interface. The first and second shaft members respectively include first and second flanges that are arranged adjacent to the interface. The first and second flanges respectively include first and second threads that are configured to cooperate with a tool during disassembly of the first and second shaft members.

20 Claims, 3 Drawing Sheets

GAS TURBINE ENGINE SHAFT MEMBERS AND MAINTENANCE METHOD

CROSS-REFERENCE TO RELATED APPLICATIONS

This application claims priority to U.S. Provisional Application No. 62/084,098, which was filed on Nov. 25, 2014 and is incorporated herein by reference.

BACKGROUND

This disclosure relates to a gas turbine engine having first and second shaft members in an interference fit relationship. More particularly, the disclosure relates to the gas turbine engine having features for separating the shaft members at an interface and a method for performing service on the shaft members.

A gas turbine engine typically includes a fan section, a compressor section, a combustor section and a turbine section. Air entering the compressor section is compressed and delivered into the combustor section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

One type of gas turbine engine includes a geared architecture used to decrease the rotational speed of the fan. In one configuration, an input shaft is connected to a low pressure compressor hub that is connected to a shaft by an interference fit at an interface. The shaft supports a low pressure turbine. The interface also includes a splined joint between the shaft and the low pressure compressor hub to withstand high torques at the interface.

Typically, these shaft members are initially secured to one another by heating the low pressure compressor hub so that the low pressure hub and shaft can be assembled in a slip-fit manner without interference. Once the parts cool, an interference fit will be provided at the interface generating a high fit load sufficient to transfer high torques at the interface.

During disassembly, it is no longer possible to heat the low pressure compressor hub requiring the shafts to be pulled apart at room temperature, which requires significant pulling force. The shafts are relatively small in diameter and are highly stressed during disassembly. A tool has been used which has fingers that extend during the disassembly process to cooperate with recesses in the shaft members. The shaft members must be machined to accommodate the fingers, which is sometimes practically not possible for some engine applications.

SUMMARY

In one exemplary embodiment, a gas turbine engine includes first and second shaft members in an interference fit relationship with one another at an interface. The first and second shaft members respectively include first and second flanges that are arranged adjacent to the interface. The first and second flanges respectively include first and second threads that are configured to cooperate with a tool during disassembly of the first and second shaft members.

In a further embodiment of the above, the first and second flanged extend radially inward into a cavity.

In a further embodiment of any of the above, the first and second shaft members are cylindrical.

In a further embodiment of any of the above, the gas turbine engine includes a low pressure turbine. The first shaft member is an inner shaft coupled to the low pressure turbine.

In a further embodiment of any of the above, the gas turbine engine includes a low pressure compressor. The second shaft member is a hub coupled to the low pressure compressor.

In a further embodiment of any of the above, the gas turbine engine includes a bearing. The hub supports the bearing.

In a further embodiment of any of the above, the gas turbine engine includes an input shaft coupled to a geared architecture that is connected to a fan. The hub is coupled to the input shaft.

In a further embodiment of any of the above, the first and second shaft members respectively include first and second splines that engage one another at the interface.

In a further embodiment of any of the above, the first shaft member abuts the second flange in an assembled condition.

In a further embodiment of any of the above, the first and second threads are ACME threads.

In another exemplary embodiment, a method of separating first and second shaft members of a gas turbine engine from one another. The first and second shaft members are coupled to one another by an interference fit at an interface. The method comprising the steps of threading first and second tools into the first and second shaft members respectively and moving the first and second tools in axially opposite directions to separate the first and second shaft members from one another at the interface.

In a further embodiment of the above, the moving step is performed by using a hydraulic drive element.

In a further embodiment of any of the above, the threading step is performed by arranging the first and second tools concentrically within the first and second shaft members.

In a further embodiment of any of the above, the first and second shaft members respectively include first and second flanges arranged adjacent to the interface. The first and second flanges respectively include first and second threads that cooperate with the first and second tools respectively.

In a further embodiment of any of the above, the first and second flanged extend radially inward into a cavity. The first and second shaft members are cylindrical.

In a further embodiment of any of the above, there is a low pressure turbine and a low pressure compressor. The first shaft member is an inner shaft coupled to the low pressure turbine. The second shaft member is a hub coupled to the low pressure compressor.

In a further embodiment of any of the above, the method includes a bearing and the hub supports the bearing.

In a further embodiment of any of the above, the first and second shaft members respectively include first and second splines that engage one another at the interface. The first shaft member abuts the second flange in an assembled condition. The first and second threads are ACME threads.

In another exemplary embodiment, a gas turbine engine includes a low pressure compressor, a low pressure turbine, a bearing and an inner shaft and a hub in an interference fit relationship with one another at a splined interface. The first shaft member is an inner shaft coupled to the low pressure turbine. The second shaft member is a hub coupled to the low pressure compressor. The hub supports the bearing. The inner shaft and the hub respectively include first and second flanges that are arranged adjacent to the interface and extend radially inward into a cavity. The inner shaft abuts the second flange in an assembled condition. The first and second flanges respectively include first and second threads that are configured to cooperate with a tool during disassembly of the first and second shaft members.

In a further embodiment of the above, the first and second threads are ACME threads.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
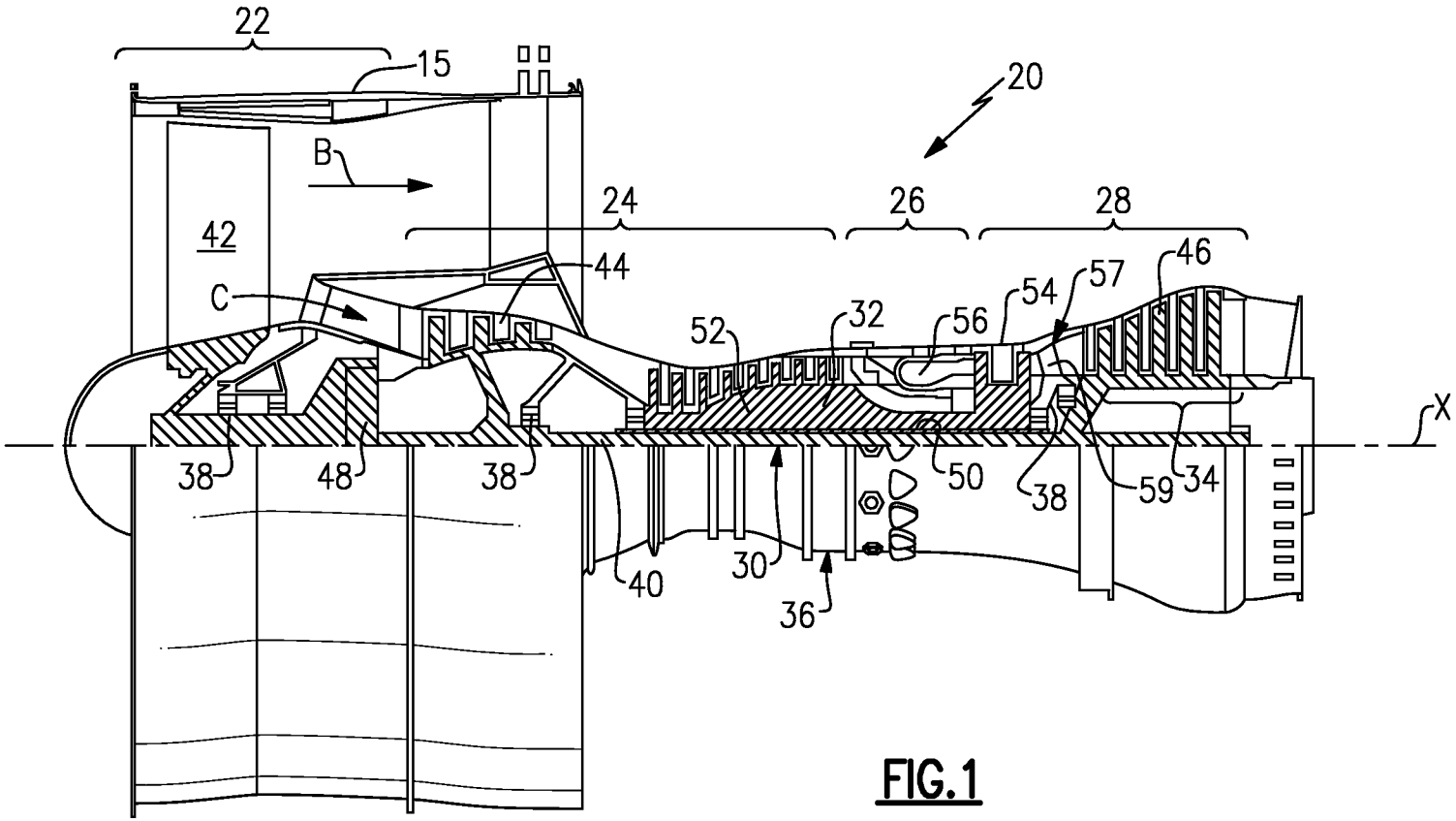
FIG. 1 schematically illustrates a gas turbine engine embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis X relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis X which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of 1 bm of fuel being burned divided by 1 bf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
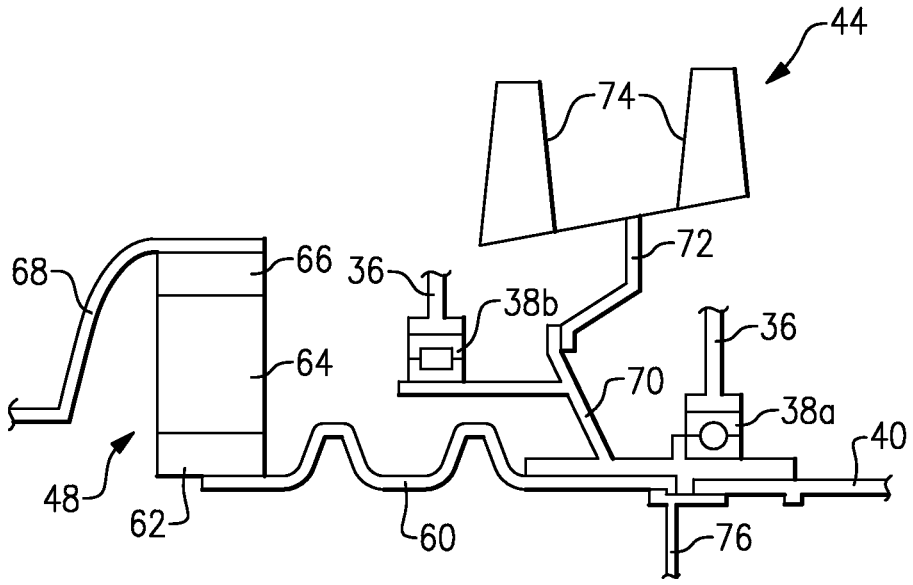
FIG. 2 is an enlarged schematic of first and second shaft members in the engine shown in FIG. 1 with an interference fit relationship at an interface.

A portion on the engine 10 is shown in greater detail in FIG. 2. An input shaft or flex shaft 60 provides a rotational input to the geared architecture 48 from the low pressure turbine 46. In the example, the geared architecture 48 includes a sun gear 62 supported at an end of the input shaft 60. The sun gear 62 meshes with intermediate gears 64 arranged circumferentially about the sun gear 62. A ring gear 66 intermeshes with the intermediate gears 64 and is coupled to a fan shaft 68 that rotationally drives the fan 42.

The engine 10 includes numerous shaft members that are secured to one another to transfer torque between components of the engine. For example, a hub 70 is coupled to an inner shaft 40 and the input shaft 60. The hub 70 supports a rotor 72 to which blades 74 of the low pressure compressor 44 are mounted. In the example, the hub 70 is supported for rotation relative to the engine static structure 36 by bearings 38*a*, 38*b*.

The inner shaft 40, input shaft 60 and hub 70 are hollow. In the example, a spanner nut 76 is arranged to enclose this hollow cavity and may be used to compress and retain these members relative to one another during engine operation.

Figure 3:
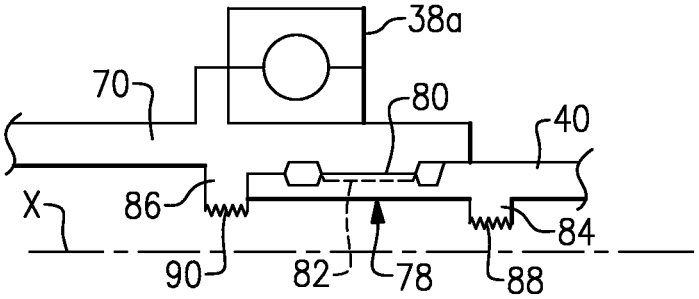
FIG. 3 is an enlarged view of the interface shown in FIG. 2.

Referring to FIG. 3, the hub 70 and inner shaft 40 are secured to one another at an interface 78 in an interference fit relationship with the engine assembled. The inner shaft 40 includes first splines 80 and the hub 70 second splines 82 that intermesh with the first splines 80 to transfer torque between the shaft members.

A first flange 84 is provided on the inner shaft 40 and extends radially inward into the cavity of the inner shaft 40. The hub 70 includes a second flange 86 that extends radially inward into the cavity. In the example, an end of the inner shaft 70 abuts the second flange 86 in the assembled condition.

The first and second flanges 84, 86 respectively include first and second threads 88, 90. The thread characteristics are determined based upon the size and materials of the shafts, which are typically selected based upon a given engine application. Thread characteristics include the number, type, size, length, pitch, roughness, hardness, material and diameter, for example. In one example, ACME threads are used. Typically, at least three threads are provided, and in another example, at least five threads are provided. In one example, the threads extend axially at least 0.5 inch (12.7 mm).

Figure 4A:
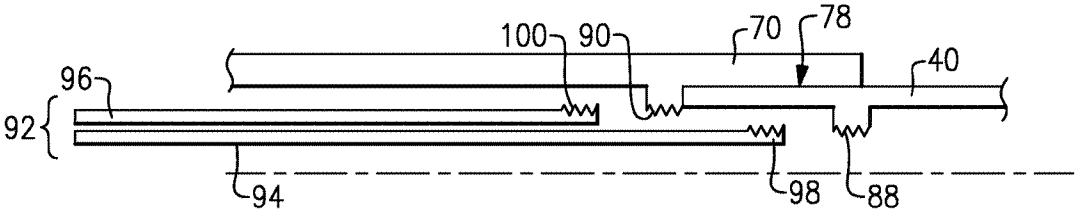
FIGS. 4A-4C are schematic illustrations of a maintenance procedure for the first and second shaft members.
Figure 4B:
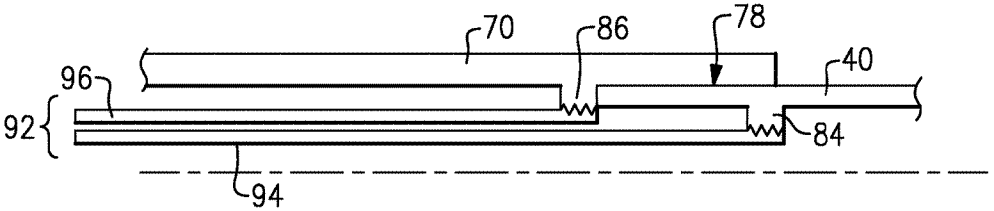
Figure 4C:
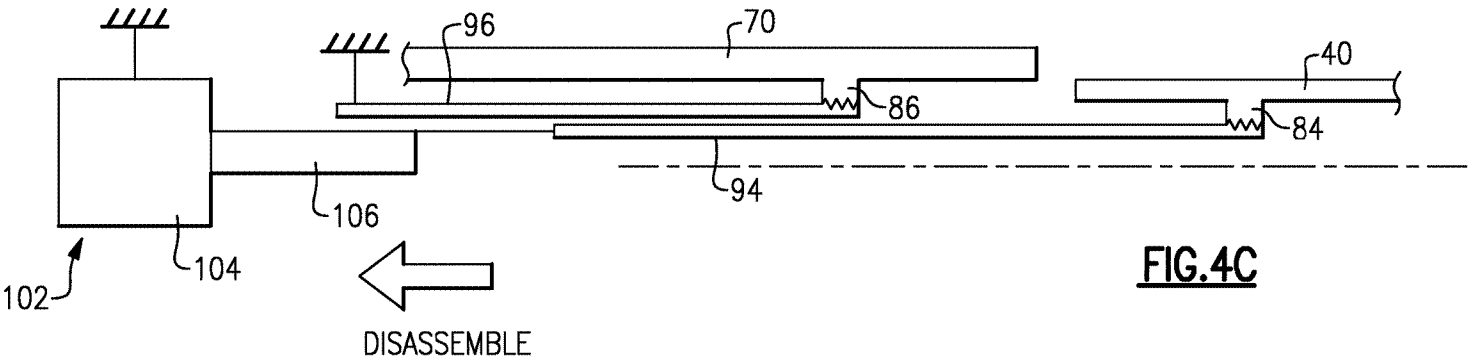

The disassembly process of the shafts is schematically shown in FIGS. 4A-4C. Referring to FIG. 4A, tooling 92 includes first and second tools 94, 96, which are cylindrical in the example. The tooling 92 may be constructed from a high carbon tool steel.

The first and second tools 94, 96 respectively include first and second ends 98, 100 that are threaded. The first and second ends 98, 100 are threaded into engagement with the first and second flanges 84, 86, respectively, as shown in FIG. 4B.

A pulling force is provided to the first and second tools 94, 96, as schematically illustrated in FIG. 4C. A drive element 102, which may include a hydraulic cylinder 104 and a ram 106, is actuated to move the first and second tools 94, 96 in axially opposite directions from one another to exert a pulling force on the interface 78 and disassemble the shafts from one another. To assemble the shafts, the hub 70 is heated before installing onto the inner shaft 40 in a slip fit relationship, after which the hub 70 cools onto the inner shaft to again provide an interference fit.

It should also be understood that although a particular component arrangement is disclosed in the illustrated embodiment, other arrangements will benefit herefrom. The disclosed shaft members can be used for other applications were multiple shafts are piloted and secured relative to one another. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A gas turbine engine comprising:

first and second shaft members in an interference fit relationship with one another at an interface, the first and second shaft members respectively including integral first and second flanges arranged adjacent to the interface, the first and second flanges respectively include first and second threads configured to cooperate with a tool during disassembly of the first and second shaft members.

2. The gas turbine engine according to claim 1, wherein the first and second flanged extend radially inward into a cavity.

3. The gas turbine engine according to claim 2, wherein the first and second shaft members are cylindrical.

4. The gas turbine engine according to claim 3, comprising a low pressure turbine, wherein the first shaft member is an inner shaft coupled to the low pressure turbine.

5. The gas turbine engine according to claim 4, comprising a low pressure compressor, wherein the second shaft member is a hub coupled to the low pressure compressor.

6. The gas turbine engine according to claim 1, wherein the first and second threads are ACME threads.

7. A gas turbine engine comprising:

first and second shaft members in an interference fit relationship with one another at an interface, the first and second shaft members respectively include first and second flanges arranged adjacent to the interface, the first and second flanges respectively include first and second threads configured to cooperate with a tool during disassembly of the first and second shaft members, wherein the first and second flanged extend radially inward into a cavity, wherein the first and second shaft members are cylindrical, and comprising:

a low pressure turbine, wherein the first shaft member is an inner shaft coupled to the low pressure turbine a low pressure compressor, wherein the second shaft member is a hub coupled to the low pressure compressor a bearing, wherein the hub supports the bearing.

8. The gas turbine engine according to claim 7, comprising an input shaft coupled to a geared architecture that is connected to a fan, wherein hub is coupled to the input shaft.

9. A gas turbine engine comprising:

first and second shaft members in an interference fit relationship with one another at an interface, the first and second shaft members respectively include first and second flanges arranged adjacent to the interface, the first and second flanges respectively include first and second threads configured to cooperate with a tool during disassembly of the first and second shaft members, wherein the first and second flanged extend radially inward into a cavity, wherein the first and second shaft members respectively include first and second splines engaging one another at the interface.

10. A gas turbine engine comprising:

first and second shaft members in an interference fit relationship with one another at an interface, the first and second shaft members respectively include first and second flanges arranged adjacent to the interface, the first and second flanges respectively include first and second threads configured to cooperate with a tool during disassembly of the first and second shaft members, wherein the first and second flanged extend radially inward into a cavity, wherein the first shaft member abuts the second flange in an assembled condition.

11. A method of separating first and second shaft members of a gas turbine engine from one another, wherein the first and second shaft members are coupled to one another by an interference fit at an interface, the method comprising the steps of:

threading first and second tools into the first and second shaft members respectively; and moving the first and second tools in axially opposite directions to separate the first and second shaft members from one another at the interface.

12. The method according to claim 11, wherein the moving step is performed by using a hydraulic drive element.

13. The method according to claim 11, wherein the threading step is performed by arranging the first and second tools concentrically within the first and second shaft members.

14. The method according to claim 13, wherein the first and second shaft members respectively include first and second flanges arranged adjacent to the interface, the first and second flanges respectively include first and second threads that cooperate with the first and second tools respectively.

15. The method according to claim 14, wherein the first and second flanged extend radially inward into a cavity, and the first and second shaft members are cylindrical.

16. The method according to claim 11, comprising a low pressure turbine and a low pressure compressor, wherein the first shaft member is an inner shaft coupled to the low pressure turbine, and the second shaft member is a hub coupled to the low pressure compressor.

17. The method according to claim 16, comprising a bearing, wherein the hub supports the bearing.

18. The method according to claim 11, wherein the first and second shaft members respectively include first and second splines engaging one another at the interface, the first shaft member abuts the second flange in an assembled condition, and the first and second threads are ACME threads.

19. A gas turbine engine comprising:

a low pressure compressor;

a low pressure turbine;

a bearing;

an inner shaft and a hub in an interference fit relationship with one another at a splined interface, the inner shaft is coupled to the low pressure turbine, the hub is coupled to the low pressure compressor, the hub supports the bearing; and wherein the inner shaft and the hub respectively include first and second flanges arranged adjacent to the interface and extending radially inward into a cavity, the inner shaft abuts the second flange in an assembled condition, the first and second flanges respectively include first and second threads configured to cooperate with a tool during disassembly of the inner shaft and the hub.

20. The gas turbine engine according to claim 19, wherein the first and second threads are ACME threads.

* * * * *